US009634423B2

(12) United States Patent
Chien et al.

(10) Patent No.: US 9,634,423 B2
(45) Date of Patent: Apr. 25, 2017

(54) MICRO PLUG CONNECTOR

(71) Applicant: Advanced-Connectek Inc., New Taipei (TW)

(72) Inventors: Ming-Lung Chien, New Taipei (TW); Ming-Yung Chang, New Taipei (TW); Guan-Ren Liu, New Taipei (TW)

(73) Assignee: Advanced-Connectek Inc., New Taipei (TW)

( * ) Notice: Subject to any disclaimer, the term of this patent is extended or adjusted under 35 U.S.C. 154(b) by 0 days.

(21) Appl. No.: 15/223,410

(22) Filed: Jul. 29, 2016

(65) Prior Publication Data

US 2017/0040735 A1 Feb. 9, 2017

(30) Foreign Application Priority Data

Aug. 6, 2015 (CN) ..... 2015 1 0474954

(51) Int. Cl.

| | |
|---|---|
| ***H01R 9/03*** | (2006.01) |
| ***H01R 13/506*** | (2006.01) |
| ***H01R 12/75*** | (2011.01) |
| ***H01R 24/64*** | (2011.01) |
| *H01R 107/00* | (2006.01) |

(52) U.S. Cl.

CPC ..... *H01R 13/506* (2013.01); *H01R 12/75* (2013.01); *H01R 24/64* (2013.01); *H01R 2107/00* (2013.01)

(58) Field of Classification Search

CPC ..... H01R 13/6598; H01R 13/6581; H01R 13/6593; H01R 13/504; H01R 9/2425

USPC ..... 439/607.54, 607.55, 660, 607.4

See application file for complete search history.

(56) References Cited

U.S. PATENT DOCUMENTS

| | | | | |
|---|---|---|---|---|
| 9,401,573 | B1 * | 7/2016 | Fernandez | H01R 13/6593 |
| 9,450,341 | B2 * | 9/2016 | Kao | H01R 13/6585 |
| 9,515,436 | B2 * | 12/2016 | Kao | H01R 24/60 |
| 2015/0111428 | A1 * | 4/2015 | Kao | H01R 13/6581 439/607.02 |
| 2015/0111430 | A1 * | 4/2015 | Kao | H01R 24/60 439/607.55 |
| 2015/0380871 | A1 * | 12/2015 | Kao | H01R 13/6658 439/607.27 |
| 2016/0013595 | A1 * | 1/2016 | Kao | H01R 13/6591 439/607.55 |
| 2016/0079711 | A1 * | 3/2016 | Chung | H01R 24/60 439/607.55 |

* cited by examiner

*Primary Examiner* — Abdullah Riyami
*Assistant Examiner* — Thang Nguyen
(74) *Attorney, Agent, or Firm* — C. G. Mersereau; Nikolai & Mersereau, P.A.

(57) ABSTRACT

A micro plug connector has an insulative housing, multiple terminals, an outer casing, a front shell and a circuit board. The outer casing covers the insulative housing and has a vertical positioning slot and two stop portions to vertically and horizontally hold the circuit board. Therefore, the circuit board is firmly fabricated in the micro plug connector without disassembling out of the outer casing due to pull of wires in a transmission cable or a power cable.

6 Claims, 13 Drawing Sheets

MICRO PLUG CONNECTOR

BACKGROUND OF THE INVENTION

1. Field of the Invention

The present invention relates to a connector, and more particularly to a micro plug connector that is able to firmly fix an inside circuit board and a shell and prevent the circuit board and the shell from being loosened by an external pressure.

2. Description of Related Art

Universal serial bus (USB) connectors are widely used for connecting to other matching connectors among variety of electronic devices for data transmission or power supplying.

With reference to FIG. 13, because of characteristics of compactness and lightweight, conventional micro USB plug connectors 90 are extensively used on transmission cables or power cables. Some manufacturers further assemble circuit boards into the micro USB plug connectors, solder wires of the transmission or power cables to the circuit board and set chips, light emitting diodes or micro switches on the circuit board to provide the micro plug connectors with additional functions.

However, the aforementioned micro plug connector with the circuit board has no fastening mechanism to firmly position the circuit board inside. Thus, after repetitive plugging and pulling, wires in the transmission or power cable pull and loosen the circuit board relative to the shell of the micro plug connector. The circuit board is prone to displace and detach from its original connection.

To overcome the shortcomings, the present invention provides a micro plug connector to mitigate or obviate the aforementioned problems.

SUMMARY OF THE INVENTION

The main objective of the invention is to provide a micro plug connector that is able to thinly fix an inside circuit board and a shell and prevent the circuit board and the shell from being loosened by an external pressure.

A micro plug connector in accordance with the present invention comprises an insulative housing, multiple terminals, an outer casing, a front shell and a circuit board. The outer casing covers the insulative housing and has a vertical positioning slot and two stop portions to vertically and horizontally hold the circuit board. Therefore, the circuit board is firmly fabricated in the micro plug connector without disassembling out of the outer casing due to pull of wires in a transmission cable or a power cable.

Other objectives, advantages and novel features of the invention will become more apparent from the following detailed description when taken in conjunction with the accompanying drawings.

DETAILED DESCRIPTION OF THE PREFERRED EMBODIMENT

Figure 1:
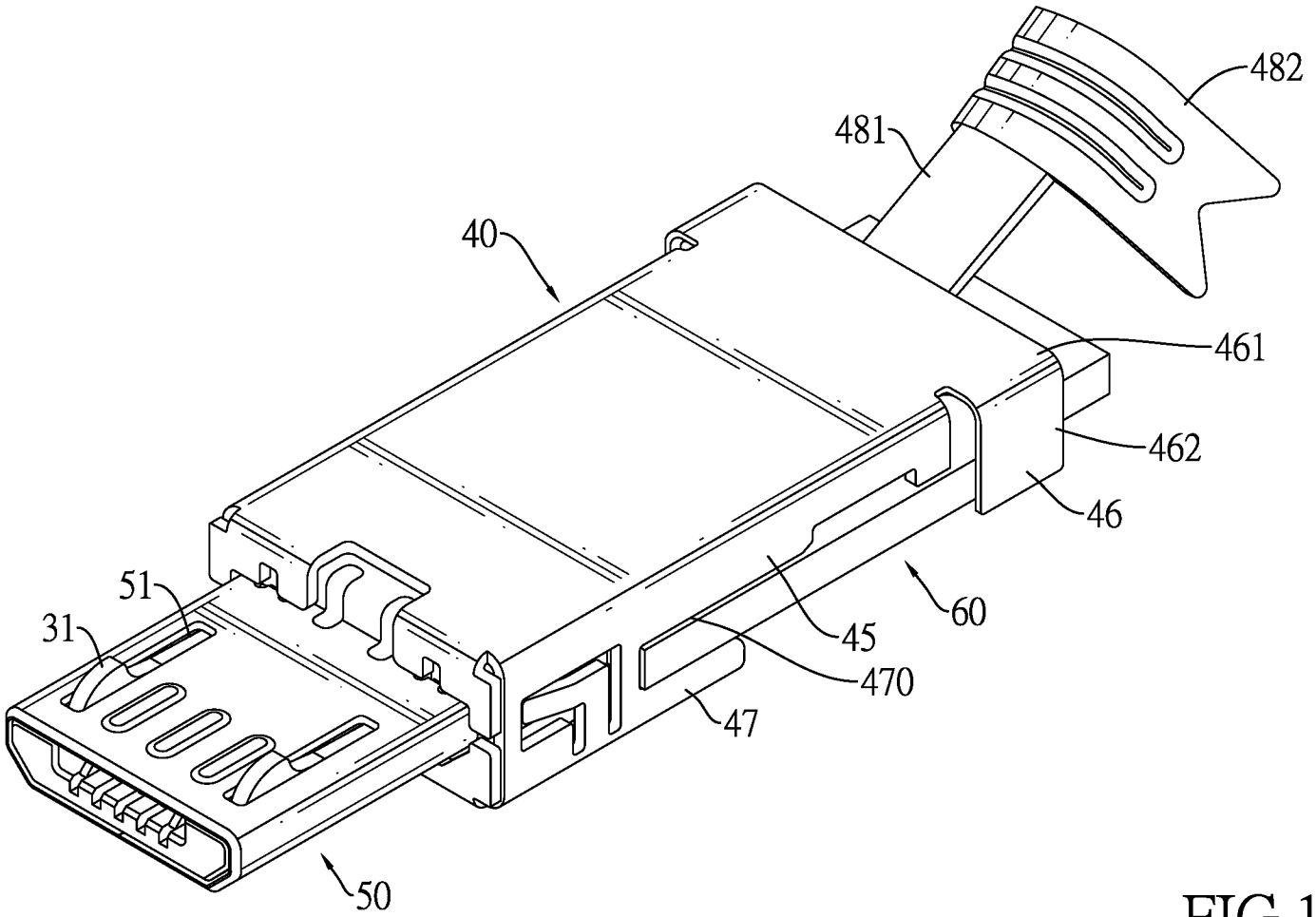
FIG. 1 is a perspective view of a first embodiment of a micro plug connector in accordance with the present invention.
Figure 2:
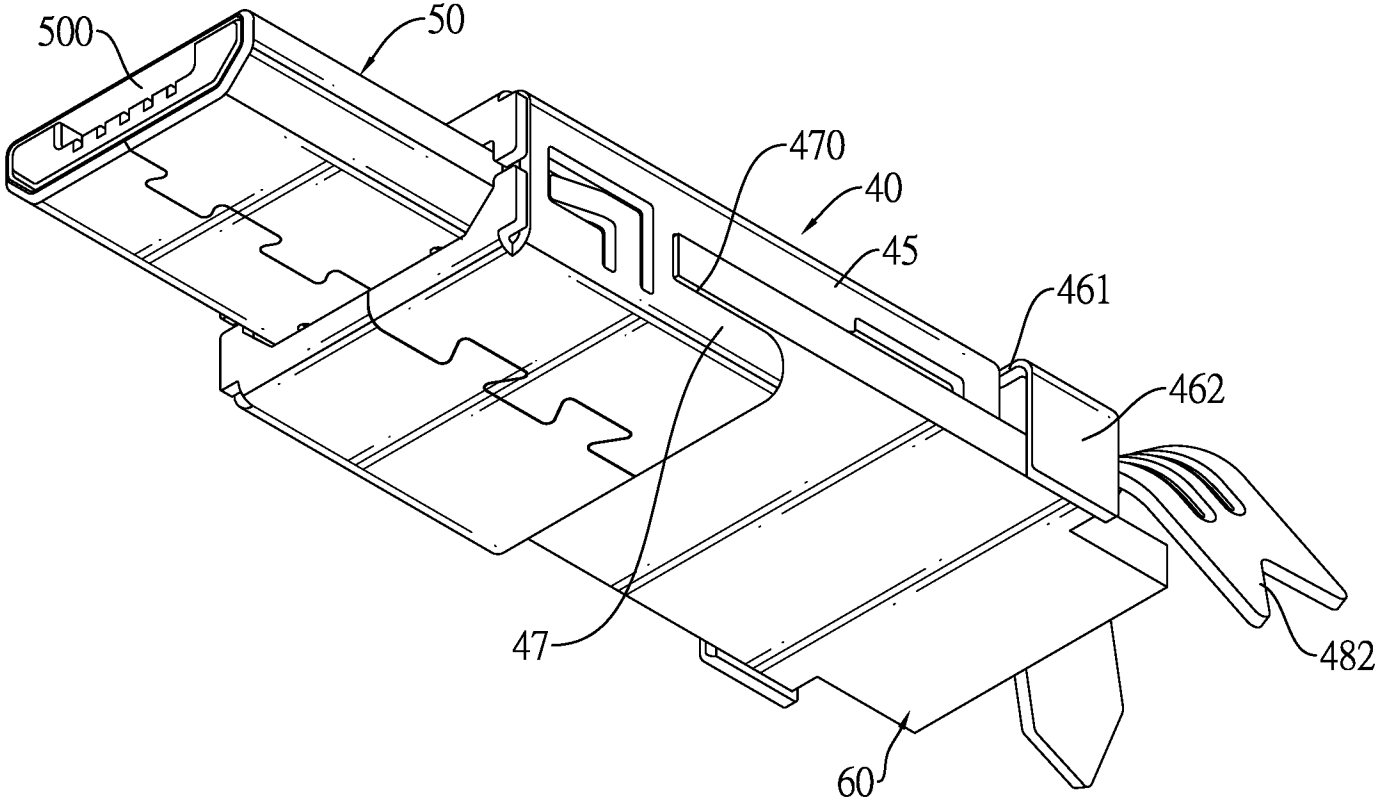
FIG. 2 is another perspective view of the micro plug connector in FIG. 1.

With reference to FIGS. 1 and 2, a first embodiment of a micro plug connector in accordance with the present invention comprises an insulative housing 10, multiple terminals 20, multiple hooking members 30, an outer casing 40, a front shell 50 and a circuit board 60.

The insulative housing 10 has a base 11 and a tongue 12. The tongue 12 is formed on and protrudes forward from the base 11.

Figure 3:
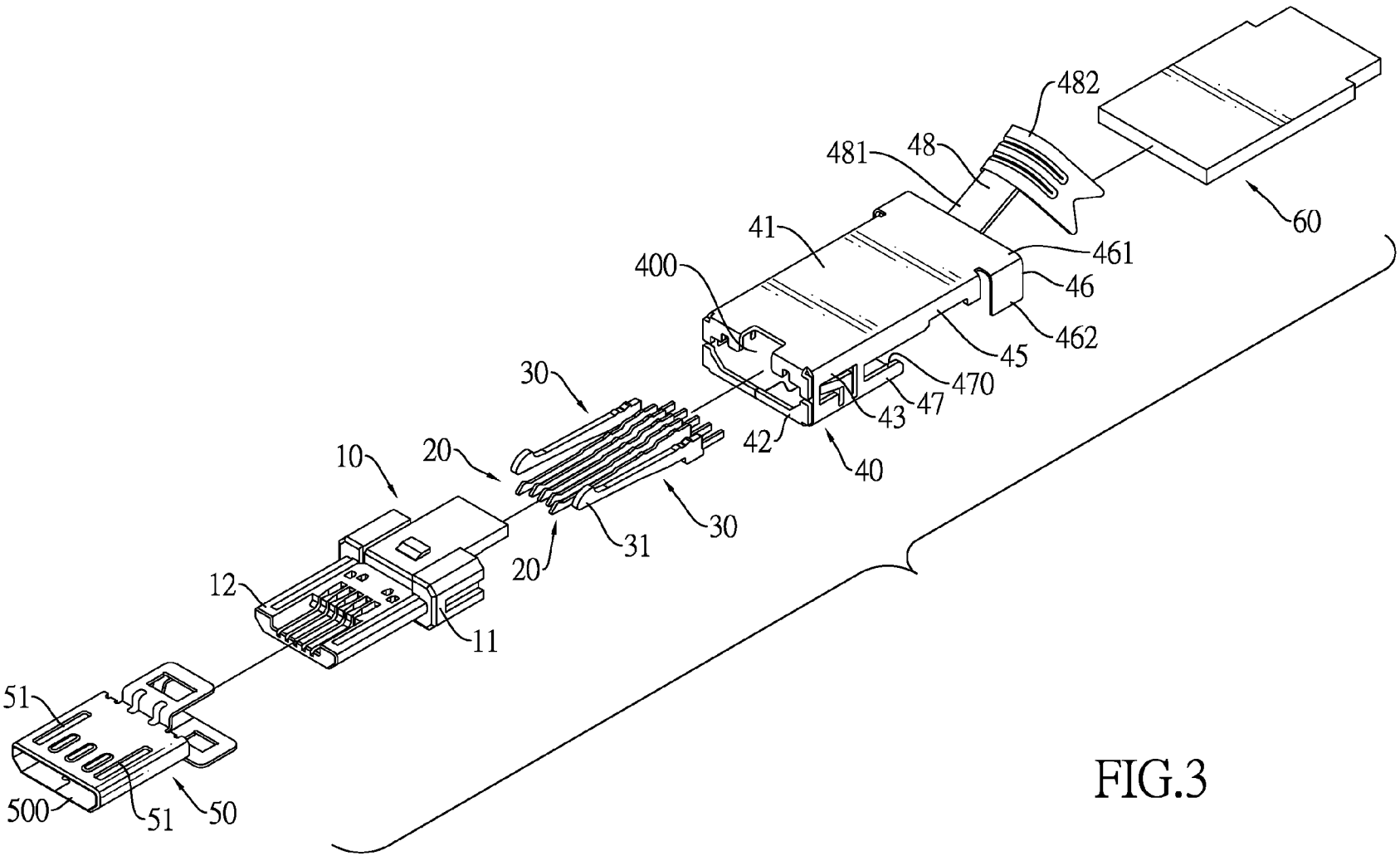
FIG. 3 is an exploded perspective view of the micro plug connector in FIG. 1.
Figure 4:
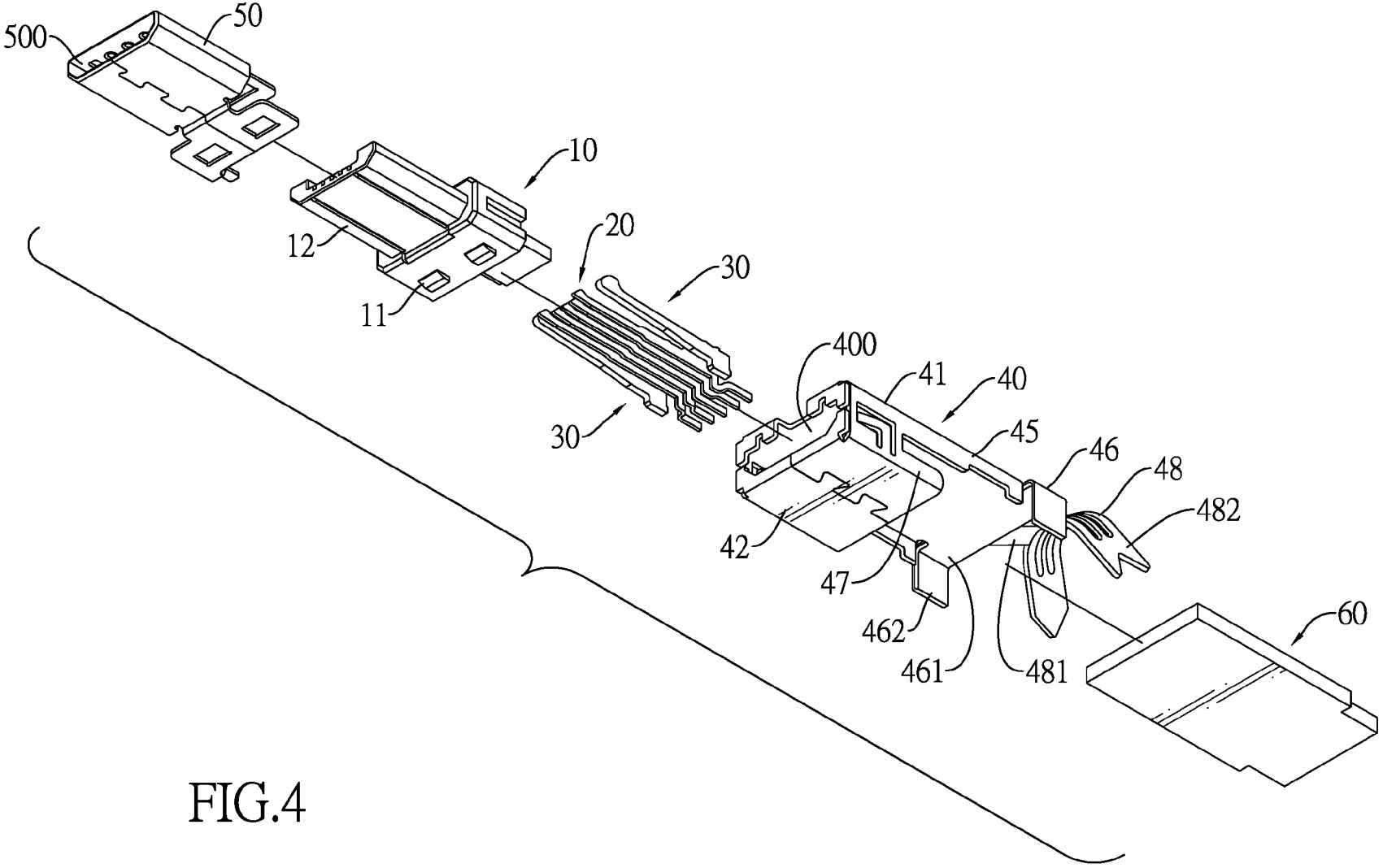
FIG. 4 is another exploded perspective view of the micro plug connector in FIG. 1.

With further reference to FIGS. 3 and 4, the terminals 20 are mounted on the base 11 and the tongue 12 of the insulative housing 10.

The hooking members 30 are mounted on the base 11 and the tongue 12 of the insulative housing 10 and each hooking member 30 has a hook 31 formed on a front end of the hooking member 30.

Figure 5:
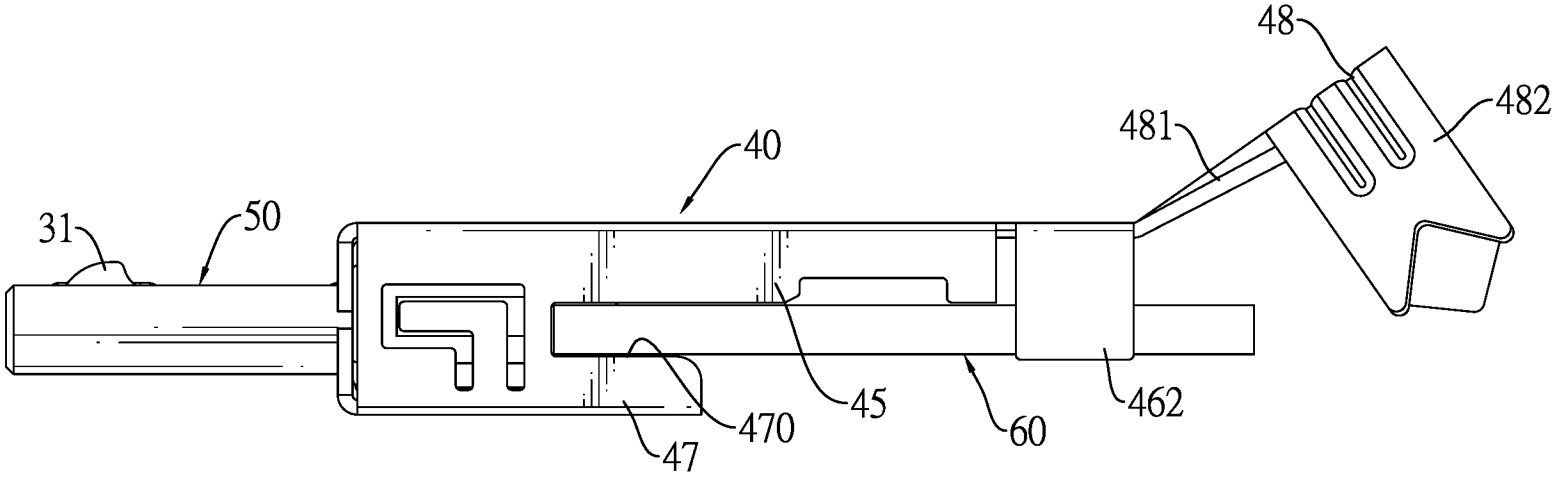
FIG. 5 is a side view of the micro plug connector in FIG. 1.
Figure 6:
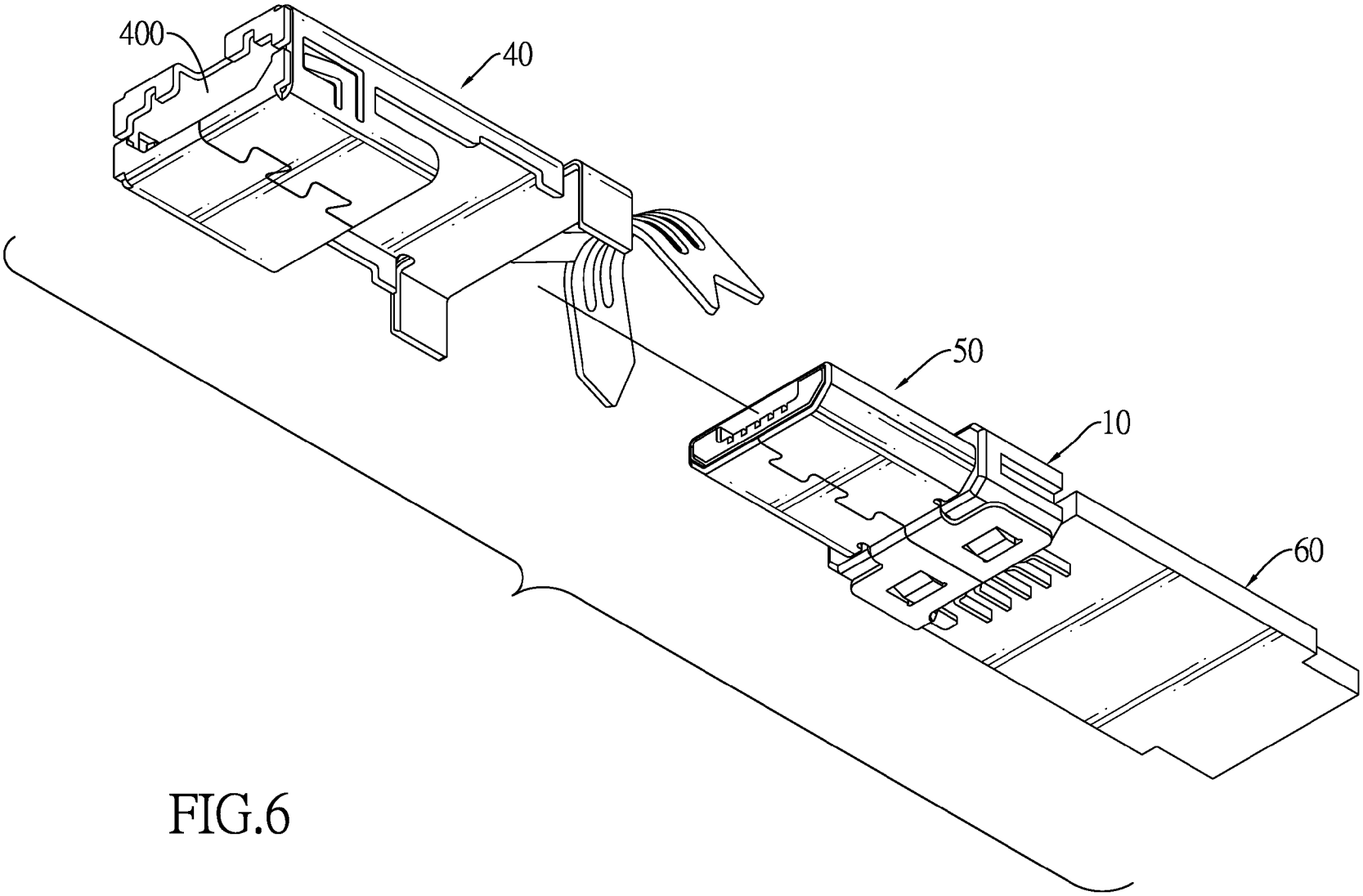
FIG. 6 is an operational perspective view of the micro plug connector in FIG. 1 showing that an outer casing is assembled to remains of the micro plug connector.
Figure 7:
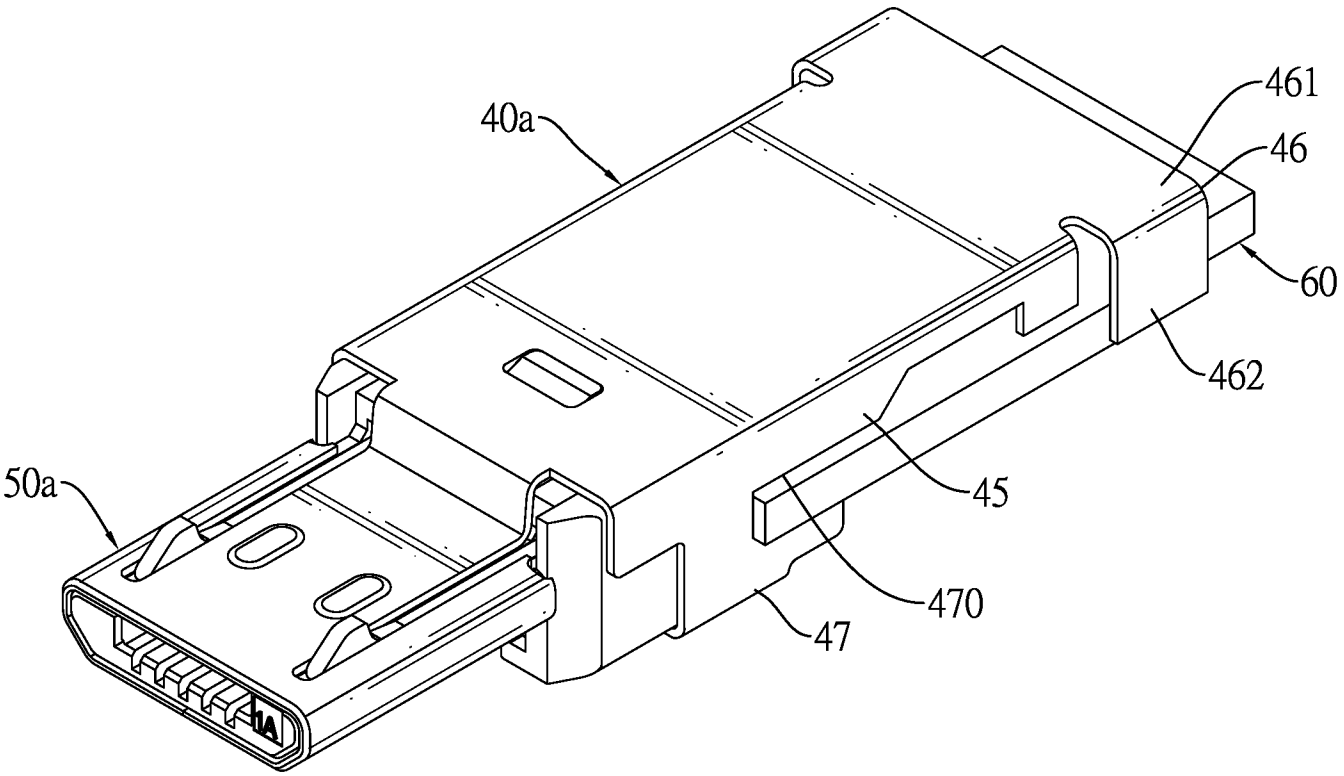
FIG. 7 is a perspective view of a second embodiment of a micro plug connector in accordance with the present invention.
Figure 8:
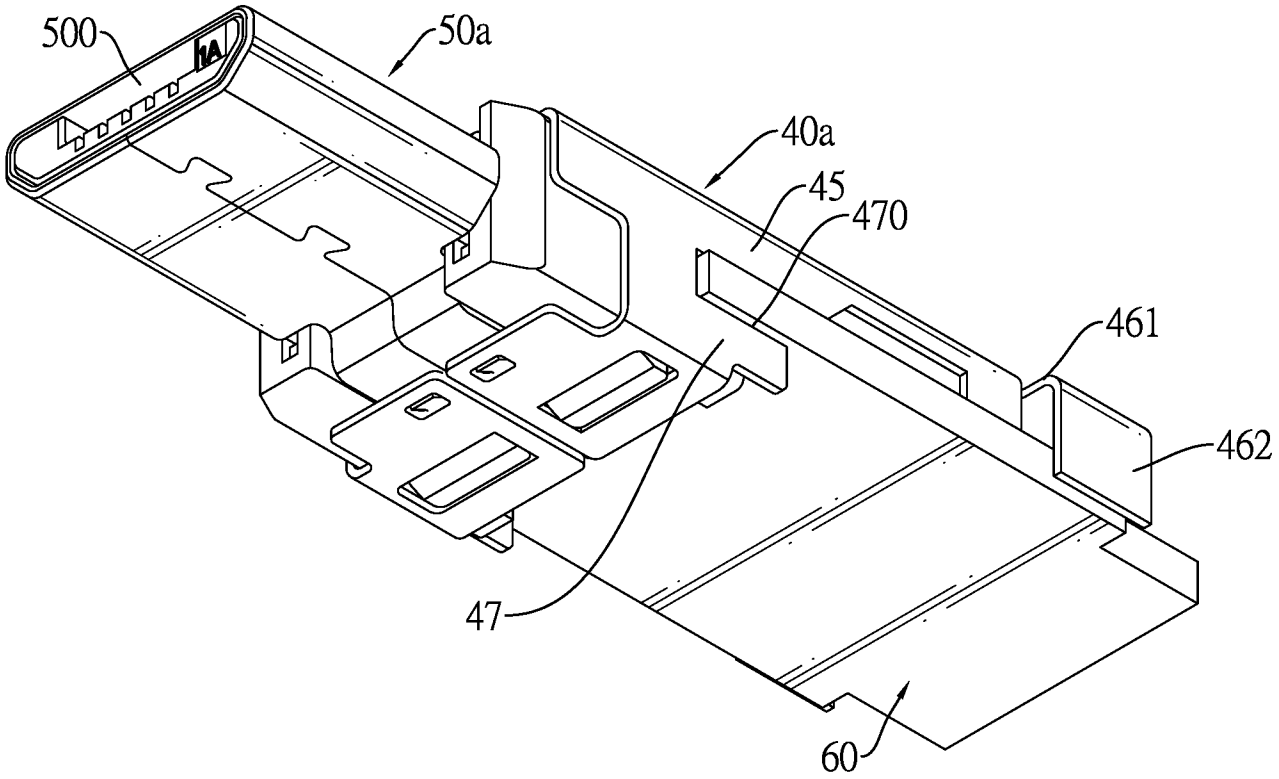
FIG. 8 is another perspective view of the micro plug connector in FIG. 7.
Figure 9:
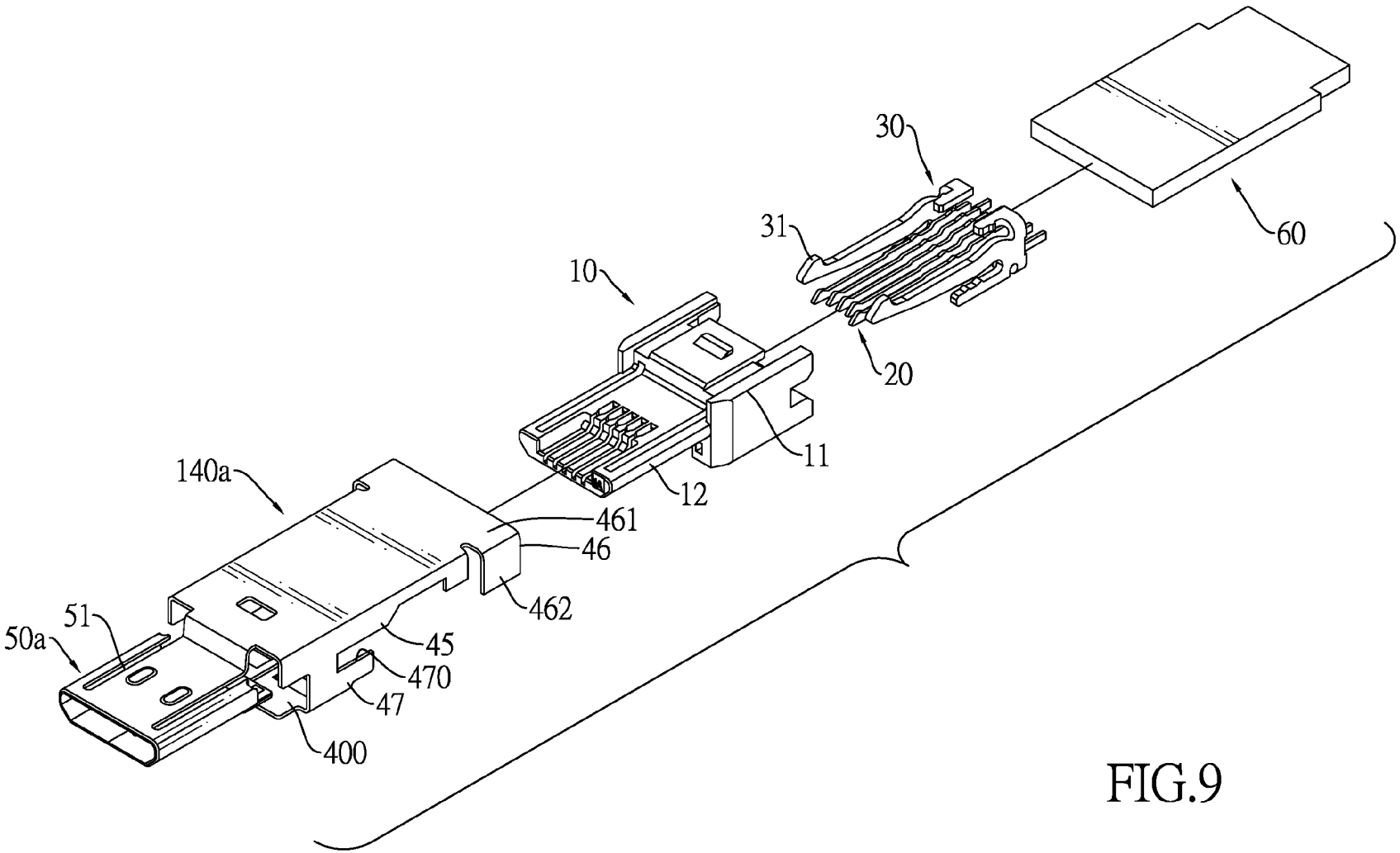
FIG. 9 is an exploded perspective view of the micro plug connector in FIG. 7.
Figure 10:
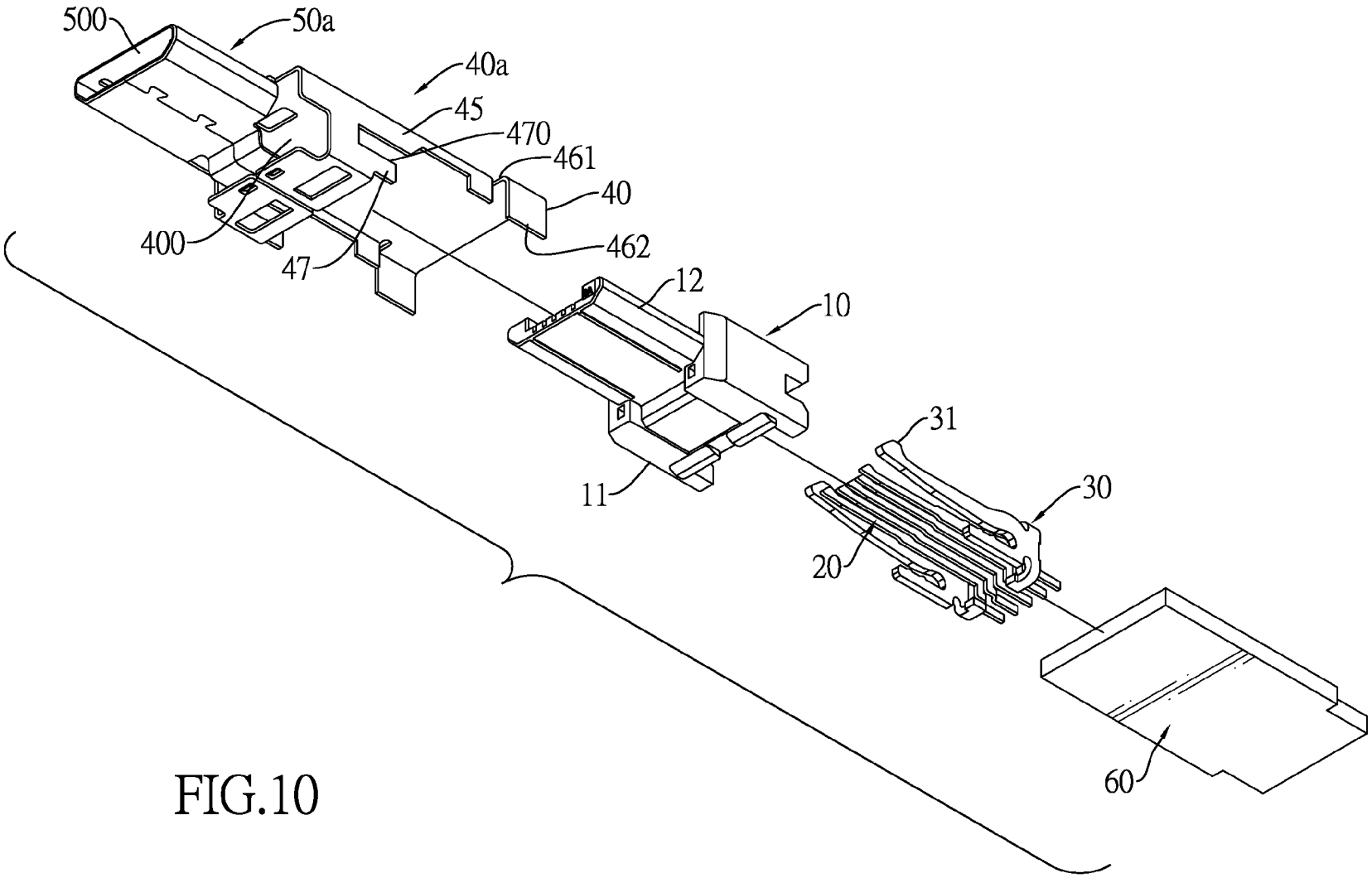
FIG. 10 is another exploded perspective view of the micro plug connector in FIG. 7.
Figure 11:
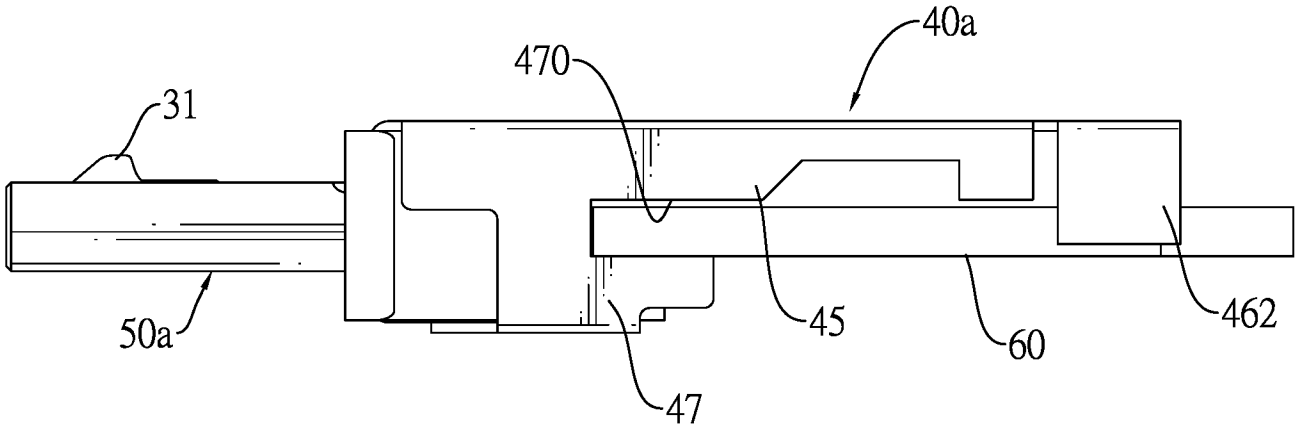
FIG. 11 is a side view of the micro plug connector in FIG. 7.
Figure 12:
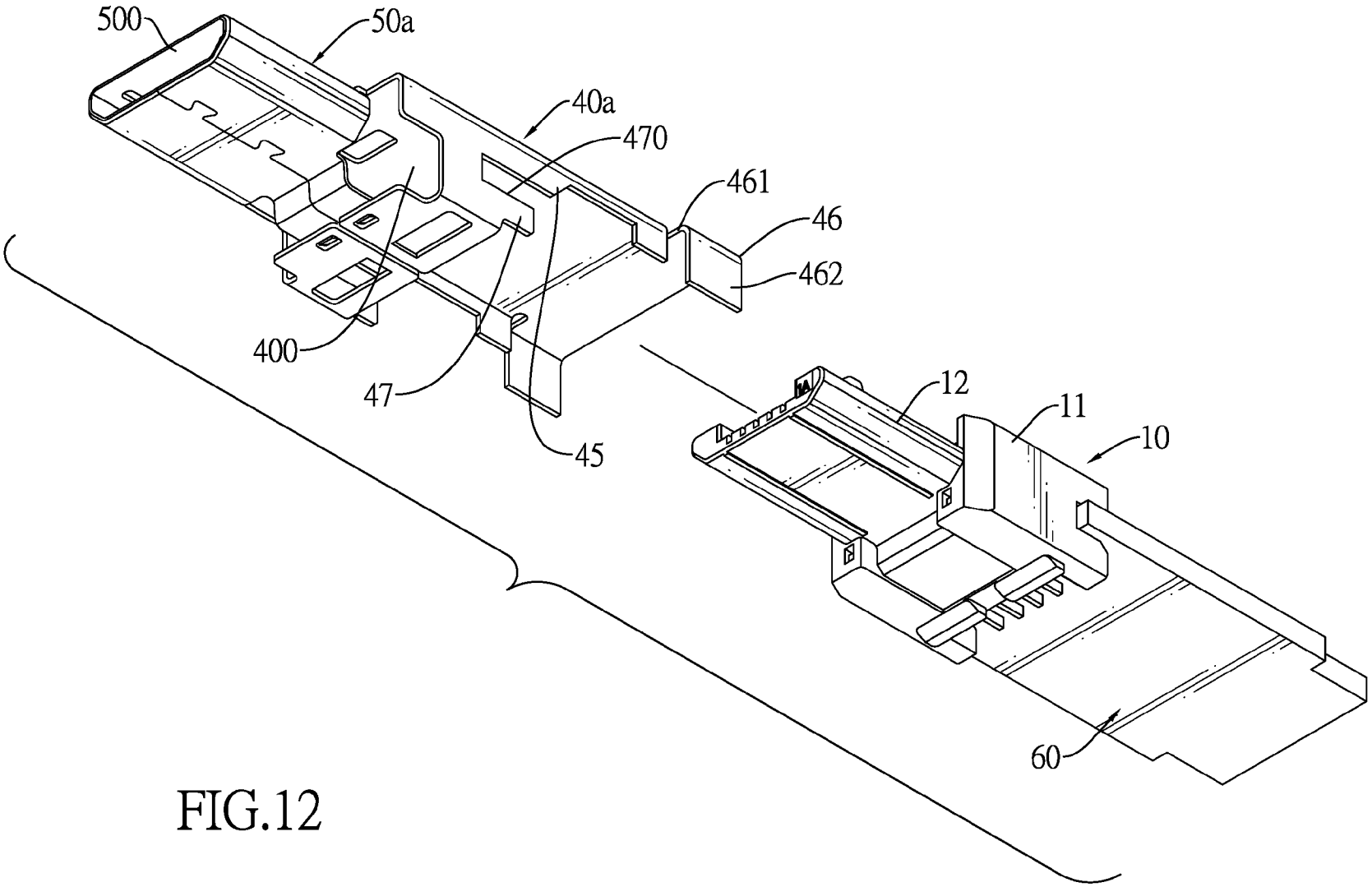
FIG. 12 is an operational perspective view of the micro plug connector in FIG. 7 showing that an outer casing is assembled to remains of the micro plug connector.
Figure 13:
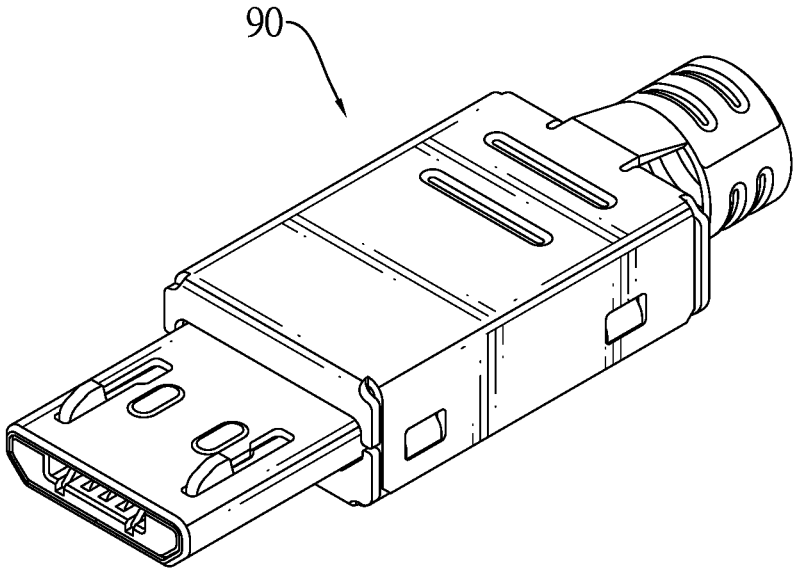
FIG.13 PRIOR ART
FIG. 13 is a perspective view of a conventional micro Universal serial bus (USB) plug connector in accordance with the prior art.

With further reference to FIGS. 5 and 6, the outer casing 40 covers the insulative housing 10 and has a cavity 400, a top board 41, a bottom board 43, two opposite side boards 42, two upper positioning plates 45, two lower positioning plates 47, two stop portions 46 and a cable holder 48.

The cavity 400 is defined in the outer casing 40 and covers the base 11 of the insulative housing 10.

The side boards 42 are formed between the top board 41 and the bottom board 43.

The upper positioning plates 45 are formed on and protrude downward respectively from two opposite sides of the top board 41.

The lower positioning plates 47 are formed on and protrude upward respectively from two opposite side edges of the bottom board 43 and correspond to the upper positioning plates 45. Each lower positioning plate 47 has a vertical positioning slot 470 defined between the lower positioning plate 47 and a corresponding upper positioning plate 45.

The stop portions 46 are formed on and protrude downward respectively from the opposite sides of the top board 41 near a rear end of the top board 41 and each stop portion 46 has a level extension tab 461 and a perpendicular extension tab 462. The level extension tab 461 is formed on and protrudes laterally outward from one of the opposite sides near the rear end of the top board 41. The perpendicular extension tab 462 is formed on and protrudes downward from the level extension tab 461.

The cable holder 48 is formed on the rear end of the top board 41 and has an extensive sheet 481 and a collar 482. The extensive sheet 481 is formed on and protrudes backward from the rear end of the top board 41. The collar 482 is C-shaped and is formed on the extensive sheet 481.

The front shell 50 is an individual and separate element relative to the outer casing 40, is mounted on the tongue 12 and has a mounting hole 500 and multiple through holes 51.

The mounting hole 500 is defined axially through the front shell 50 and is disposed around the tongue 12 of the insulative housing 10.

The through holes 51 are defined through the front shell 50 and the hooks 31 are mounted through the through holes 51.

The circuit board 60 is mounted in the vertical positioning slots 470 of the outer casing 40, is located between and abuts the stop portions 46, and is connected to the terminals 20.

With reference to FIGS. 7 to 12, a second embodiment of a micro plug connector in accordance with the present invention comprises an insulative housing 10, multiple terminals 20, multiple hooking members 30, an outer casing 40*a*, a front shell 50*a* and a circuit board 60. The font shell 50*a* is formed integrally on a front end of the outer casing 40*a* as one piece.

The outer casing 40, 40*a* of the micro plug connector vertically and horizontally positions the circuit board 60 with the vertical positioning slots 470 and the stop portions 46, which prevents the circuit board 60 from swaying or shifting vertically and horizontally. Thus, the circuit board 60 is firmly fabricated in the micro plug connector without disassembling out of the outer casing 40 due to pull of wires in a transmission cable or a power cable.

Even though numerous characteristics and advantages of the present invention have been set forth in the foregoing description, together with details of the structure and function of the invention, the disclosure is illustrative only. Changes may be made in the details, especially in matters of shape, size, and arrangement of parts within the principles of the invention to the full extent indicated by the broad general meaning of the terms in which the appended claims are expressed.

What is claimed is:

1. A micro plug connector comprising:

an insulative housing having a base; and a tongue formed on and protruding forward from the base;

multiple terminals mounted on the base and the tongue of the insulative housing;

an outer casing covering the insulative housing and having a cavity defined in the outer casing and covering the base of the insulative housing;

a top board;

a bottom board;

two opposite side boards formed between the top board and the bottom board;

two upper positioning plates formed on and protruding downward respectively from two opposite sides of the top board;

two lower positioning plates formed on and protruding upward respectively from two opposite side edges of the bottom board and corresponding to the upper positioning plates, and each lower positioning plate having a vertical positioning slot defined between the lower positioning plate and a corresponding upper positioning plate; and two stop portions formed on and protruding downward respectively from the opposite sides of the top board near a rear end of the top board;

a front shell having a mounting hole defined axially through the front shell and mounted around the tongue of the insulative housing; and a circuit board mounted in the vertical positioning slots of the outer casing, located between and abutting the stop portions, and connected to the terminals.

2. The micro plug connector as claimed in claim 1, wherein each stop portion has a level extension tab formed on and protruding laterally outward from one of the opposite sides near the rear end of the top board; and a perpendicular extension tab formed on and protruding downward from the level extension tab.

3. The micro plug connector as claimed in claim 2, wherein the outer casing further has a cable holder formed on the rear end of the top board and having an extensive sheet formed on and protruding backward from the rear end of the top board; and a collar being C-shaped and formed on the extensive sheet.

4. The micro plug connector as claimed in claim 3, wherein multiple hooking members are mounted on the base and the tongue of the insulative housing and each hooking member has a hook formed on a front end of the hooking member.

5. The micro plug connector as claimed in claim 4, wherein the front shell is an individual and separate element relative to the outer casing.

6. The micro plug connector as claimed in claim 5, wherein the font shell is formed integrally on a front end of the outer casing as one piece.

* * * * *